US007625219B2

(12) United States Patent
Osato et al.

(10) Patent No.: US 7,625,219 B2
(45) Date of Patent: Dec. 1, 2009

(54) ELECTRICAL CONNECTING APPARATUS

(75) Inventors: Eichi Osato, Tokyo (JP); Yoshihito Goto, Tokyo (JP)

(73) Assignee: Kabushiki Kaisha Nihon Micronics, Musashino-shi, Tokyo (JP)

( * ) Notice: Subject to any disclaimer, the term of this patent is extended or adjusted under 35 U.S.C. 154(b) by 192 days.

(21) Appl. No.: 11/817,492

(22) PCT Filed: Apr. 21, 2005

(86) PCT No.: PCT/JP2005/008097

§ 371 (c)(1),
(2), (4) Date: Aug. 30, 2007

(87) PCT Pub. No.: WO2006/114895

PCT Pub. Date: Nov. 2, 2006

(65) Prior Publication Data

US 2009/0035960 A1 Feb. 5, 2009

(51) Int. Cl.
*H01R 12/00* (2006.01)

(52) U.S. Cl. ..... 439/71

(58) Field of Classification Search ..... 439/71, 439/72, 73, 68, 62, 82, 330, 331, 525, 259
See application file for complete search history.

(56) References Cited

U.S. PATENT DOCUMENTS

| | | | | |
|---|---|---|---|---|
| 4,395,084 | A * | 7/1983 | Conrad | 439/331 |
| 4,437,718 | A * | 3/1984 | Selinko | 439/591 |
| 4,445,735 | A * | 5/1984 | Bonnefoy | 439/66 |
| 4,593,961 | A * | 6/1986 | Cosmo | 439/66 |
| 4,993,955 | A * | 2/1991 | Savant | 439/73 |
| 5,074,798 | A * | 12/1991 | Carter | 439/72 |
| 5,207,584 | A * | 5/1993 | Johnson | 439/66 |
| 5,236,367 | A * | 8/1993 | McHugh et al. | 439/73 |
| 5,273,442 | A * | 12/1993 | Laub | 439/73 |
| 5,328,383 | A * | 7/1994 | Savant | 439/266 |
| 5,594,355 | A * | 1/1997 | Ludwig | 324/755 |
| 5,888,075 | A * | 3/1999 | Hasegawa et al. | 439/73 |
| 7,121,842 | B2 * | 10/2006 | Kimura | 439/73 |
| 7,303,404 | B2 * | 12/2007 | Osato et al. | 439/71 |
| 7,338,293 | B2 * | 3/2008 | Gilk | 439/66 |
| 2006/0183356 | A1 * | 8/2006 | Kimura | 439/73 |

FOREIGN PATENT DOCUMENTS

| | | |
|---|---|---|
| JP | 10-177886 | 6/1998 |
| JP | 11-031566 | 2/1999 |
| JP | 2002-260801 | 9/2002 |
| JP | 2003-123874 | 4/2003 |
| JP | 2003-297506 | 10/2003 |

* cited by examiner

*Primary Examiner*—Neil Abrams
*Assistant Examiner*—Harshad C Patel
(74) *Attorney, Agent, or Firm*—Ingrassia Fisher & Lorenz, P.C.

(57) ABSTRACT

The electrical connecting apparatus disclosed herein includes a frame member having a recess for receiving a device under test provided with a plurality of electrodes, a plurality of contacts provided in correspondence to the electrodes, a plurality of slots formed in the bottom portion of the recess of the frame member and arranged parallel to each other so as to receive the contacts such that the tip of each contact can abut the corresponding electrode, an elastic member disposed across the slots over the bottom portion within the recess to elastically hold the contacts, and a cap member mounted on the frame member and sandwiching the elastic body together with the frame member.

10 Claims, 8 Drawing Sheets

ELECTRICAL CONNECTING APPARATUS

BACKGROUND OF THE INVENTION

1. Field of the Invention

The present invention relates to an electrical connecting apparatus suitable for use as an auxiliary device in an electrical test of a semiconductor device such as an integrated circuit.

2. Description of Prior Art

For a test of electric characteristics of an integrated circuit (IC) sealed by a package, a mold or the like, an auxiliary device for testing including an electrical connecting apparatus called socket is generally used. Each electrode of a semiconductor device as a device under test is removably connected with an electric circuit such as a tester. Such an electrical connecting apparatus are described in Patent Document 1 (Japanese Patent Appln. Public Disclosure No. 11-31566 Official Gazette) and Patent Document 2 (Japanese Patent Appln. Public Disclosure No. 2003-297506 Official Gazette).

Each electrical connecting apparatus described in Patent Documents 1 and 2 has a frame with a recess for receiving a device under test formed in the central portion. In the frame, a plurality of contacts called probes are incorporated from the underside of the frame through a rod-like elastic body for elastically supporting the contacts. The contacts are arranged at intervals in the extending direction of each side of the bottom face of the recess such that the tips are projected into the recess from the slot formed on the bottom face of the recess. The semiconductor device as a device under test is mounted within the recess so that its electrode may abut the tips of the corresponding contacts. When pressing force toward the bottom portion of the recess is applied to the semiconductor device mounted on the recess, each contact supported on the elastic body is pressed against the corresponding conductive path of the wiring base plate attached to the underside of the frame. Each conductive path of the wiring base plate is connected to the corresponding connecting terminal of a tester, that is, a device under test, whereby each contact can undergo a predetermined electrical test by the tester when the electric circuit of the tester is connected with each electrode of the device under test.

In the conventional assembling process of the electrical connecting apparatus, a rod-like elastic body for elastically supporting each contact is formed in a lower part of a frame prior to attachment of the wiring base plate to the underside of the frame and inserted into a recess opening downward. The elastic body inserted into the recess is supported at both ends by both end walls of the recess, thereby to be held at a predetermined position. After the assembling of the elastic body into the frame, a plurality of contacts each having a receiving portion for receiving the elastic body formed are inserted into the frame through a corresponding slot from the underside of the frame so that each of the receiving portion may fit the elastic body. After these contacts are assembled, the wiring base plate is attached to the underside of the frame so as to close the open end of the recess accommodating the elastic body, whereby each contact is connected to the corresponding conductive path of the wiring base plate.

However, when any breakage is caused to the contacts and the broken contact should be replaced with a new contact, the wiring base plate must be removed from the frame for the replacement. It is not easy to re-attach the removed wiring base plate correctly to the underside of the frame so that the plural conductive paths formed thereon may match the plural contacts.

Also, in a state that the wiring base plate is removed from the frame, the recess accommodating the elastic body with the plural contacts attached opens downward; therefore, if a flexure occurs to the elastic body whose both ends are elastically supported, there is a risk that both the ends might fall off supporting portions. This falling off of the elastic body from the recess means that all the contacts supported by the elastic body would fall off. Consequently, replacement of the contacts requires a careful treatment so that the elastic body may not fall off the predetermined position while the wiring base plate is being removed from the frame.

Furthermore, the wiring base plate needs to be replaced according to the kind of a tester or the contents of a test by the tester, and a careful treatment is required so that the elastic body holding the plural contacts may not come off the frame every time the wiring base plate is replaced.

SUMMARY OF THE INVENTION

An object of the present invention is, therefore, to provide an electrical connecting apparatus which is easier in replacing the contacts than the conventional ones.

Another object of the present invention is to provide an electrical connecting apparatus which enables to replace contacts without removing a wiring base plate.

The apparatus of the present invention comprises: a frame member having a recess for receiving a device under test including a plurality of electrode; a plurality of contacts provided in correspondence to the electrodes; a plurality of slots formed on the bottom of the recess of the frame member and arranged in parallel to each other so as to receive the contacts so that the tip of each contacts can contact the corresponding electrodes; an elastic body disposed across the slots over the bottom within the recess and elastically holding the contacts; and a cap member mounted on the frame member, elastically holding the contacts, and sandwiching the elastic body together with the frame member.

Furthermore, a wiring base place on the underside of which wiring portions corresponding to the contacts are formed can be secured to the underside of the frame member.

Also, a falling-off preventing portion capable of engaging with the corresponding edges of the slots can be provided at the tail portion of each contact.

Each contact can have a fitting recess formed for allowing the elastic body to be press fitted and press-fitting the elastic body into the fitting recess, thereby elastically coupling the elastic body and each contact. The fitting recess can be formed into various shapes such as rectangular, arc-like or polygonal ones according to a cross-sectional shape of the elastic body so far as the elasticity of the elastic body can maintain the coupling of both.

The contacts receive the elastic force of the elastic body. When the contacts do not receive any pressing force from the electrodes of the device under test, this elastic force makes the tips of the contacts project from the slots into the recess to retain them.

The parts where the contacts abut the wiring portion can be formed as a curved surface.

The recess can be formed into a rectangular plane, and the cap member can be composed of an annular member having a shape of rectangular plane to be fitted into the recess. Also, a face where the elastic member of the annular member abuts can have a staged portion formed so as to restrain a shear deformation of the elastic body in order to restrain excessive movement of the contact portions of the contacts on the wiring portion, accompanying the shear deformation of the elastic body due to the pressing force from the electrodes.

In the upper inner edge portion of the cap member can be formed a guide face for guiding the device under test to a testing position where the electrodes of the device under test correspond to the tips of the contacts.

According to the electrical connecting apparatus of the present invention, the elastic member for elastically retaining the contacts are disposed across the slots for receiving the contacts on the frame member and no opening is formed for allowing the elastic member to fall into a space within the frame member which accommodates the elastic member such as conventional ones; therefore, even if the cap member which sandwiches the elastic member between itself and the frame member is removed from the frame member, the elastic body disposed across the slots on the frame member does not fall down like the conventional ones, so that the contacts retained by the elastic body can be surely held within the frame member.

Consequently, replacement work of the contacts can be completed in such a manner as the elastic member disposed at a predetermined position on the frame member is removed from above the frame member together with the plural contacts retained thereon, the contact to be replaced is removed from the elastic member and replaced with a new contact, the elastic member is disposed at the predetermined position from above the frame member, and thereafter, the cap member is attached to the frame member.

Accordingly, in this work to replace the contacts, there occurs no unexpected falling off of the elastic member as heretofore, and the contacts can be easily replaced in comparison with the conventional one.

Also, as it is possible to replace the contact in a state that the wiring base plate is attached to the frame member, removing and attaching works of the wiring base plate are not required every time the contacts are replaced, prompt and easy replacement of the contacts can be realized.

By providing each contact with a falling-off preventing portion capable of engaging with the edge of the slot, unexpected falling off of the contacts can be surely prevented.

Also, by interfitting, the fitting recess formed in each contact and the elastic body can be coupled surely and easily.

Where there is no load when the contacts are applied no pressing force from the electrodes of the device under test, sure electrical contact of the electrodes of the device under test and the corresponding contacts can be gained when the device under test receives the pressing force toward the bottom of the recess, by holding the tips as they are projected from the slots into the recess.

By making the contact portion of the contacts a curved surface, a damage by the abutment between the contact portion and the wiring portion of the wiring base plate can be prevented, thereby improving durability of both contacts and wiring portion.

Also, by restraining excessive movement of the contacts on the wiring portion accompanying a shear deformation of the elastic body, it is possible to improve durability of the elastic body and to restrain acceleration of degradation of the wiring portion due to sliding of the contacts.

Also, forming of a guide face for guiding the device under test to the upper inner edge portion of the cap member enables to place the device under test within the recess at a predetermined correct attitude, and accurate and prompt progress of the test can be promoted.

EXPLANATION OF THE REFERENCE NUMERALS

Figure 1:
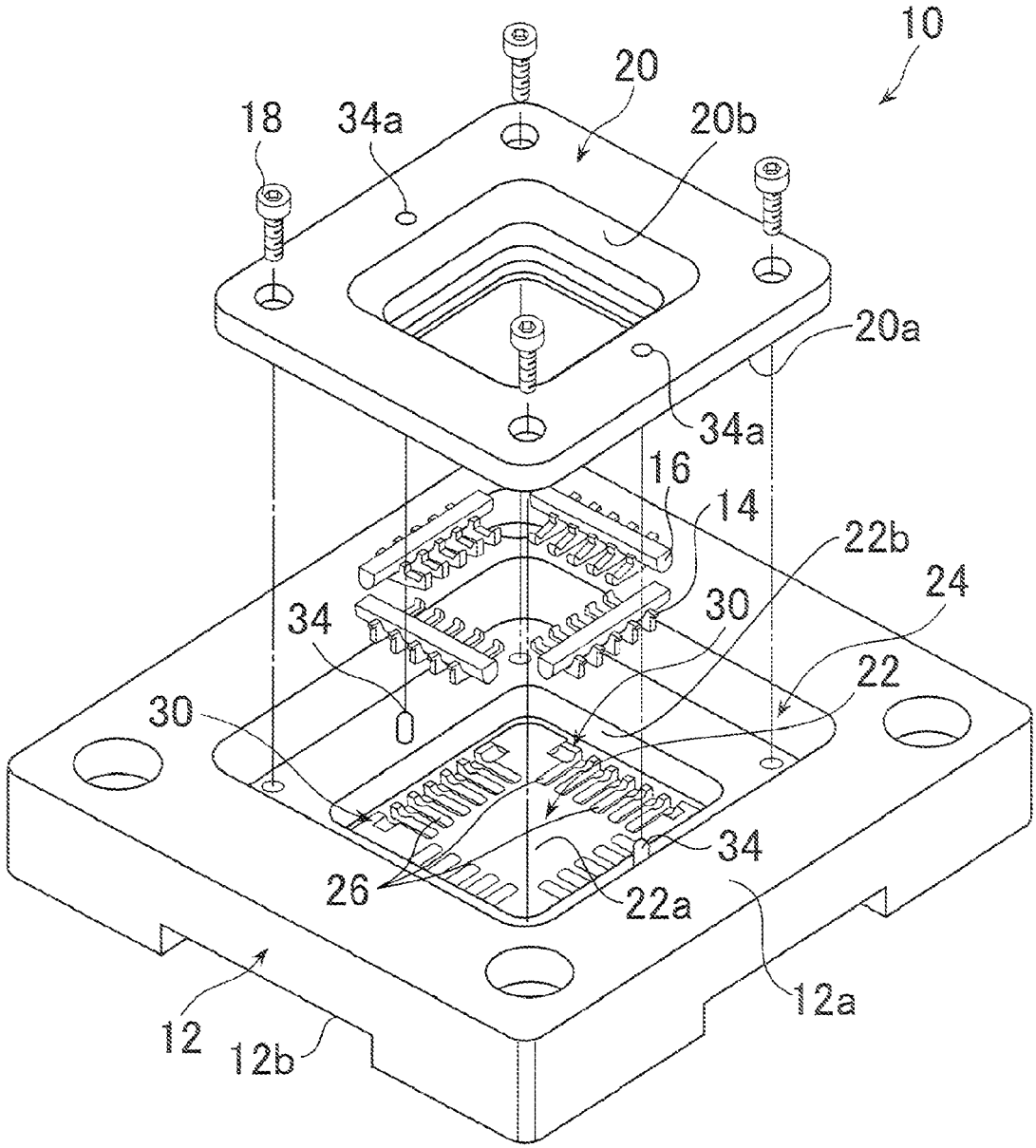
FIG. 1 is a perspective view showing an exploded state of the electrical connecting apparatus according to the present invention.

10 electrical connecting apparatus
12 frame member
14 contact
16 elastic member
20 cap member
22 recess
26 slot
28 (staged portion) edge
30 shallow groove
32 fitting recess
36 semiconductor device
38 wiring base plate
38*a* wiring portion

PREFERRED EMBODIMENT OF THE INVENTION

The electrical connecting apparatus 10 according to the present invention comprises, as shown in FIG. 1, a plate-like frame member 12 having a generally rectangular planar shape, a plurality of contacts 14 called probes to be assembled into the frame, a plurality of rod-like elastic bodies 16 with which a plurality of contacts 14 are respectively coupled, and a cap member 20 having a generally rectangular annular member to be removably attached to the frame member 12 through bolts 18.

The frame member 12 is made of a non-conductive material such as a synthetic resin material, in the central portion of which a recess 22 having a rectangular planar shape is formed to open upward, and on the upper face 12*a* of which is formed a rectangular enlarged opening 24 slightly larger than the bore of the recess and surrounding the opening edge portion of the recess 22 and having a similar figure to the recess 22. The enlarged opening 24 has a slightly larger planar shape than the outer shape of the cap member 20, thereby serving as a fitting hole for receiving the cap member 20 (see FIG. 7)

In the rectangular bottom portion 22*a* of the recess 22, a plurality of slots 26 extending at right angles to each corresponding side from the vicinity of each side of the recess 22 toward the central portion of the recess 22 at intervals in the extending direction of each side of the bottom portion 22*a*. Each slot 26 is formed to penetrate from the upper face of the bottom portion 22*a* to the underside 12*b* of the frame member 12.

Figure 2:
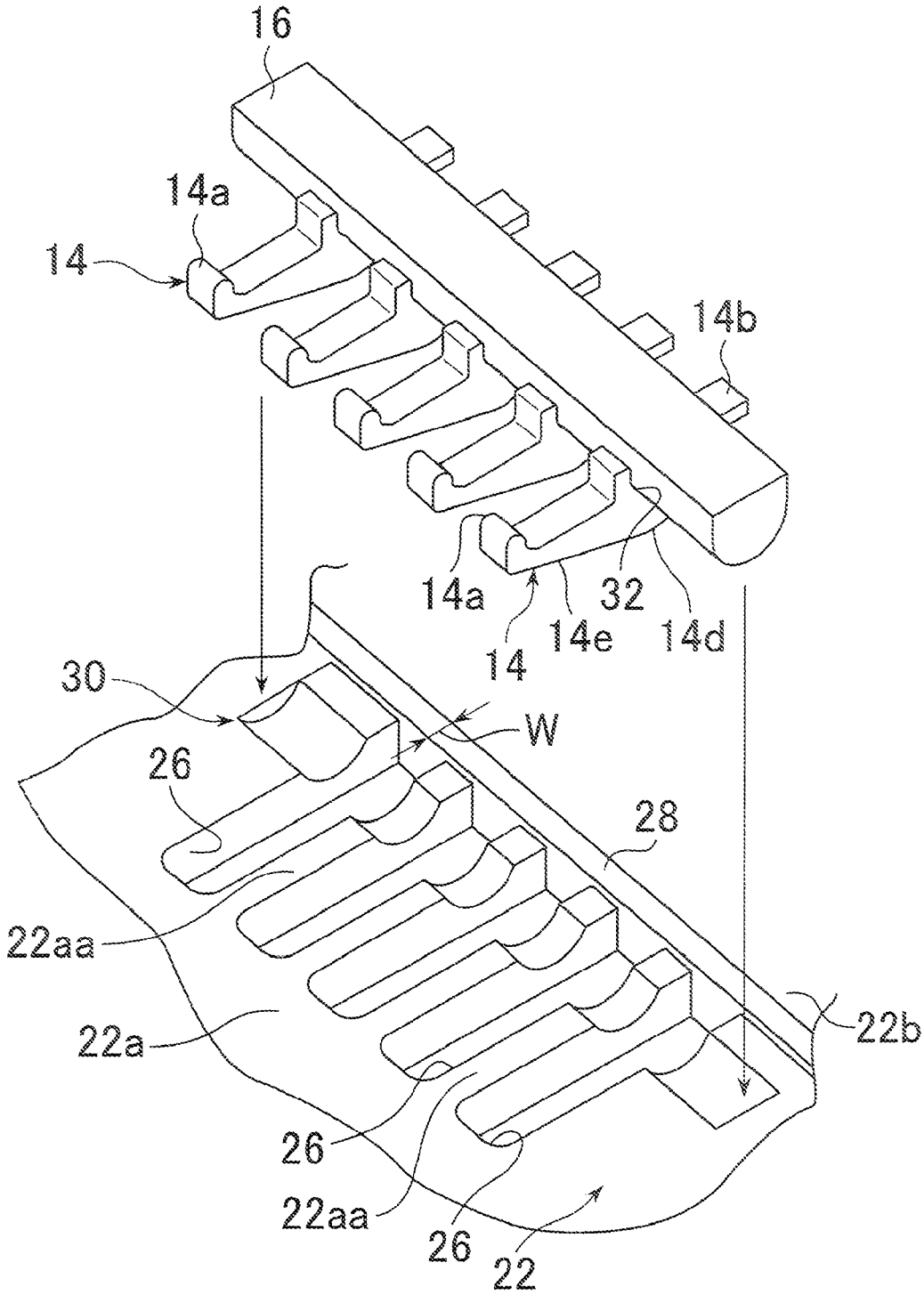
FIG. 2 is a perspective view showing an assembling process of a probe assembly into the frame member shown in FIG. 1.

As shown in FIG. 2 in an enlarged state, the outer ends of respective slots 26 are formed at intervals W from an erected circumferential wall 22*b* of the recess 22, forming a staged portion 28 having a width dimension W to be close to the outer end of the slot 26. This staged portion 28, being located at the outer end portion of each slot 26, constitutes an edge of each slot 26. Also, a shallow groove 30 having an arc-like cross sectional shape crossing each slot 26 near the outer end of each slot line is also formed in the row of the slots 26. In the illustration, four shallow grooves 30 are formed along the respective sides of the bottom portion 22*a* of the recess 22. Both ends of each shallow groove 30 cross each slot 26 of the corresponding slot group and extends outward of the width direction of the slot exceeding the outermost slots 26 of each slot group.

Figure 3:
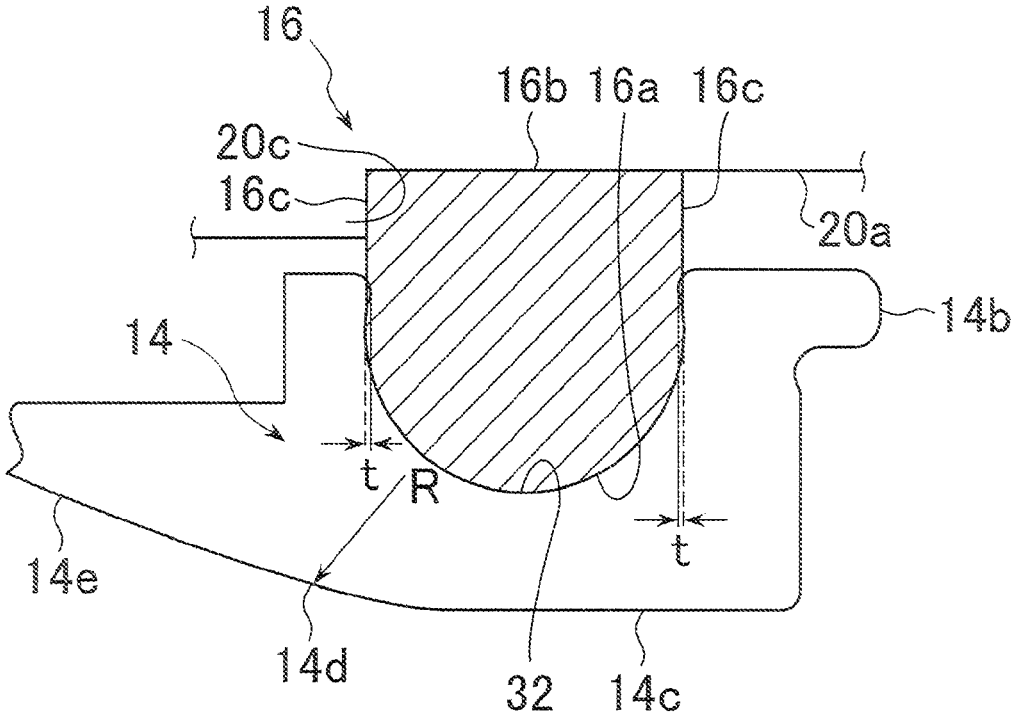
FIG. 3 is a front elevation showing a coupled state of the elastic body and contacts of the probe assembly shown in FIG. 2.

The elastic member 16 is made of rubber, for example. The elastic member 16 has, as shown in FIG. 3, a semicircular bottom face 16*a* corresponding to the arc-like shape of the shallow groove 30 as seen in the cross section, and has a pair of perpendicular side faces 16*c*, 16*c*, each extending downward from the flat top face 16*b* to the semicircular bottom face 16*a*.

Each contact 14 to be coupled with the elastic member 16 is, as is well known heretofore, made of a conductive metal member. The contacts 14 are coupled with each elastic member 16 so that tips 14*a* rising upward of the contacts 14 can project upward, as mentioned later, from the slots 26 and that the lower edges of the contacts 14 can be received into the slots 26 in correspondence to the slots 26 at predetermined intervals in the longitudinal direction of the elastic member 16.

To be coupled with the elastic member 16, the upper edge of each contact 14 is provided with a circular fitting recess 32 opening upward near the tail portion of the contact 14. The fitting recess 32 is formed to cover an angular area exceeding the semicircular area of the arc-like bottom portion 16*a* of the elastic member 16. Therefore, when the fitting recess 32 is fitted into the arc-like bottom portion 16*a* of the elastic member 16, a margin t for fastening is given to each of both perpendicular side faces 16*c* of the elastic member 16, and this margin t enables the elastic member 16 and each contact 14 to be coupled therewith can be surely coupled because of the elasticity of the elastic member 16.

A stretched portion 14*b* projecting from the tail portion of the contact is formed at the upper edge of each contact 14. The stretched portion 14*b*, as mentioned later, projects along the edge of each slot 26, that is, the staged portion 28 shown in FIG. 2 in the width direction above the staged portion when the contacts 14 are assembled into the frame member 12.

The contacts 14 also has, near the tail portion, a horizontal lower edge portion 14*c* substantially parallel to the upper edge where the fitting recess 32 is provided, and this horizontal edge portion is linked to an inclined lower edge portion 14*e* via the curved surface 14*d* having the radius of curvature R. The inclined lower edge portion 14*e* extends from the curved surface 14*d* toward the tip 14*a* at an angle of elevation.

Figure 4:
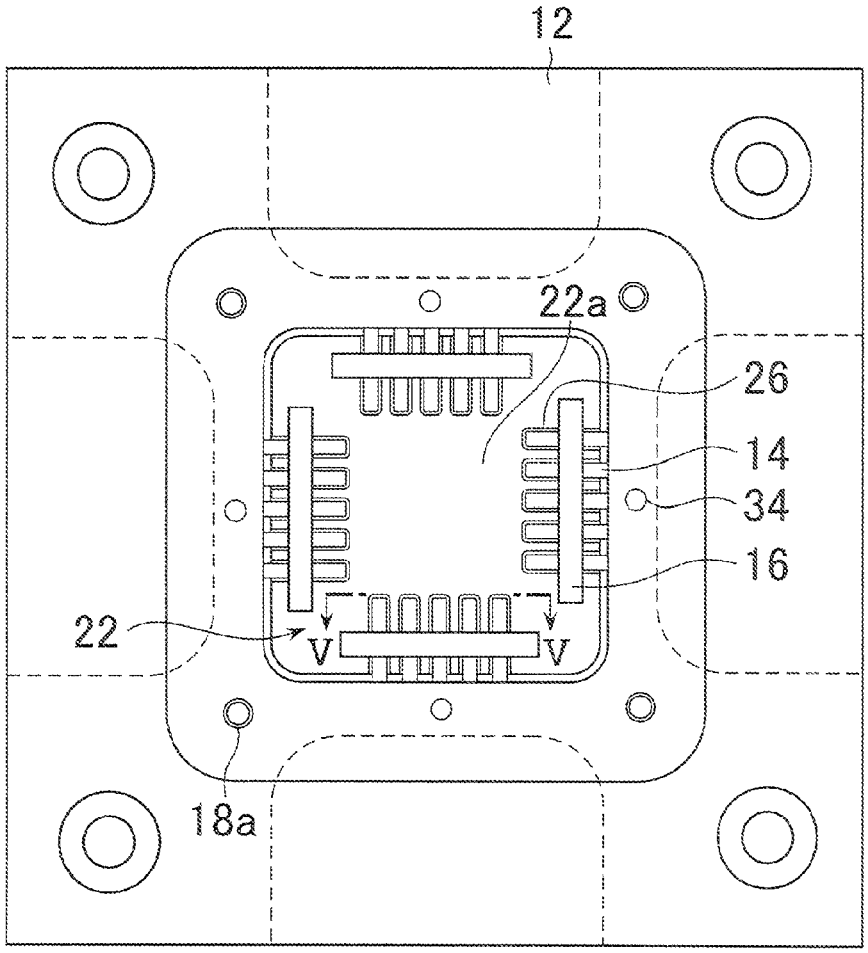
FIG. 4 is a plan view of the frame member into which the probe assembly shown in FIG. 2 is assembled.

As shown in FIG. 3, when a predetermined number of contacts 14 are aligned and coupled with the elastic members 16 by fitting of the circular bottom face 16*a* of each elastic member 16 into each fitting recess 32, the probe assembly 14, 16 is constituted as shown in FIG. 2. This probe assembly 14, 16 is dropped from the upper face 12*a* of the frame member 12 into the slot 26 and the shallow groove 30 within the recess 22 of the frame member 12 so that each contact 14 constituting the probe assembly may be received in each slot 26 and that the circular bottom face 16*a* of the elastic member 16 may be received in the shallow groove 30. This enables the probe assembly 14, 16 to be assembled into the frame member 12. The assembled state of each probe assembly 14, 16 into the frame member 12 is shown in FIGS. 4 and 5.

Figure 5:
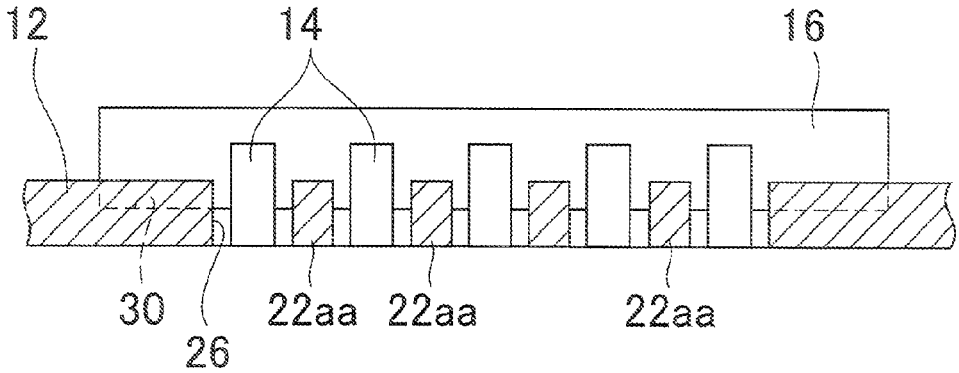
FIG. 5 is a sectional view obtained along the line V-V in FIG. 4.

As shown in FIG. 5, the elastic member 16 to be coupled with the corresponding contact 14 is mounted at both ends on the shallow groove 30 formed on the bottom portion 22*a* of the recess 22, and in addition, the part between both ends is mounted on the beam portions 22*aa* located between the slots 26 of the bottom portion 22*a* and supported thereby, so that the elastic member 16 does not fall downward of the recess 22 but is surely held within the shallow groove 30. Consequently, in the assembling process of the probe assembly in the electrical connecting apparatus 10, there occurs no unexpected falling down of the elastic member 16 and the contacts 14 held thereby from the frame member 12 as a unit.

Figure 6:
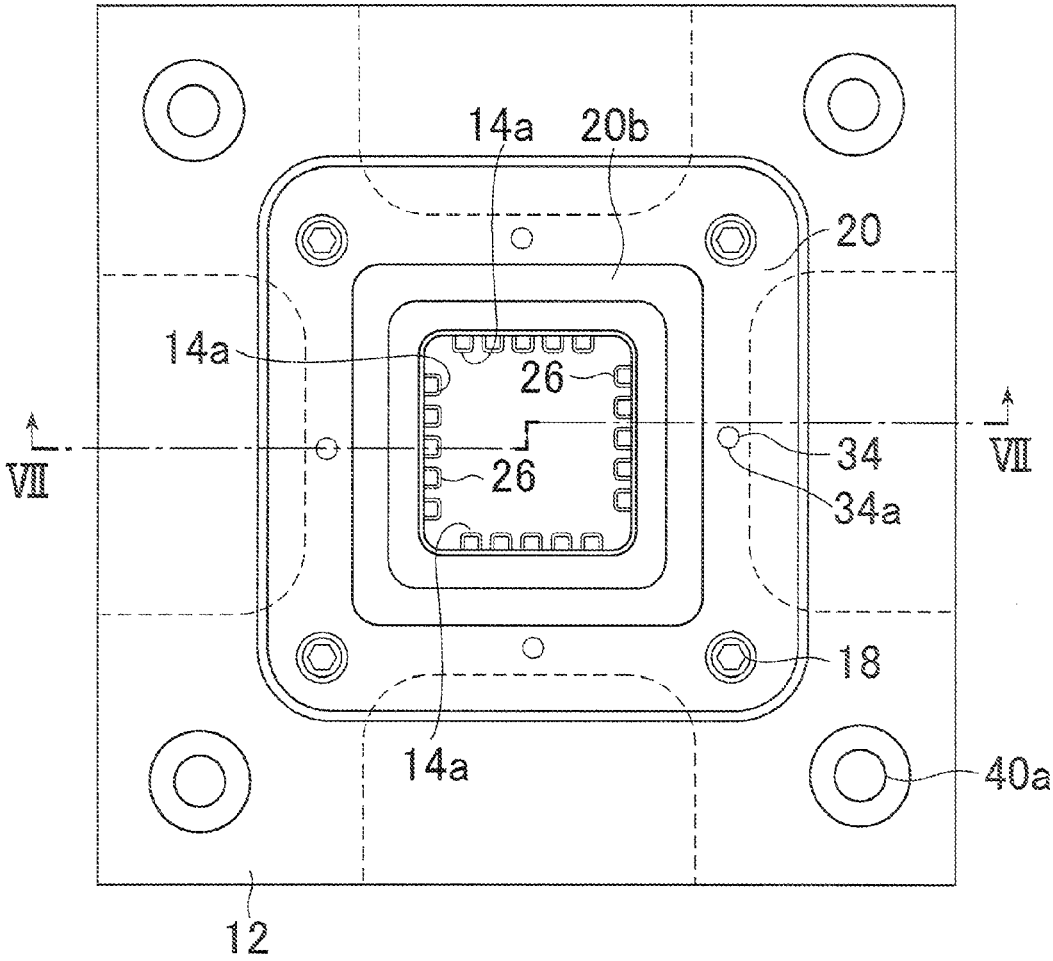
FIG. 6 is a plan view of the frame member on which the cap member is mounted after the probe assembly is assembled.
Figure 7:
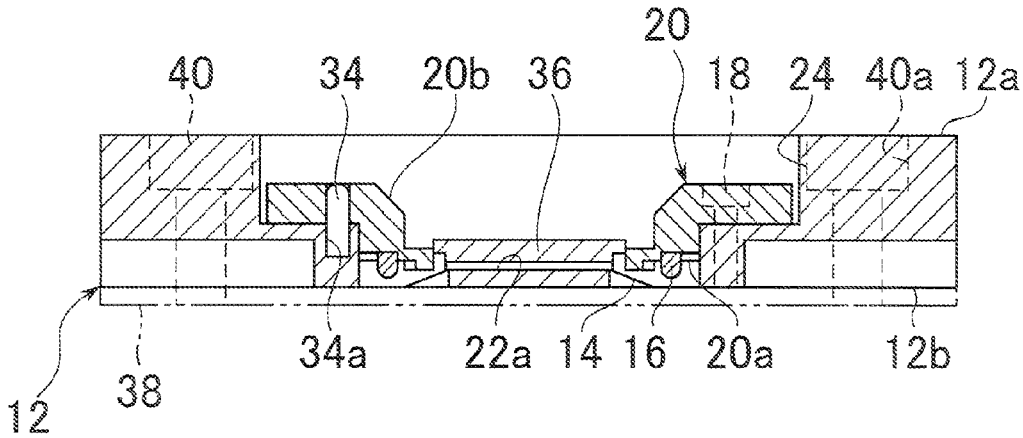
FIG. 7 is a sectional view obtained along the line VII-VII in FIG. 6.

After each probe assembly 14, 16 is assembled into the frame member 12, as shown in FIGS. 6 and 7, the cap member 20 made of, e.g., the same synthetic resin material as that of the frame member 12 is secured to the enlarged opening 24 of the frame member 12 with a bolt 18 screwed into each screw hole 18*a* (see FIG. 4) of the frame member 12. For positioning of this cap member 20, a positioning pin 34 is provided in the staged portion of the enlarged opening 24. By disposing the cap member 20 within the enlarged opening 24 so that the positioning pin 34 may be received in the pin hole 34*a* formed in the cap member 20, as clearly shown in FIG. 6, the cap member 20 can be coupled with the frame member 12 at a correct attitude so as to expose the tip 14*a* of each contact 14 properly from the inner edge.

Figure 8:
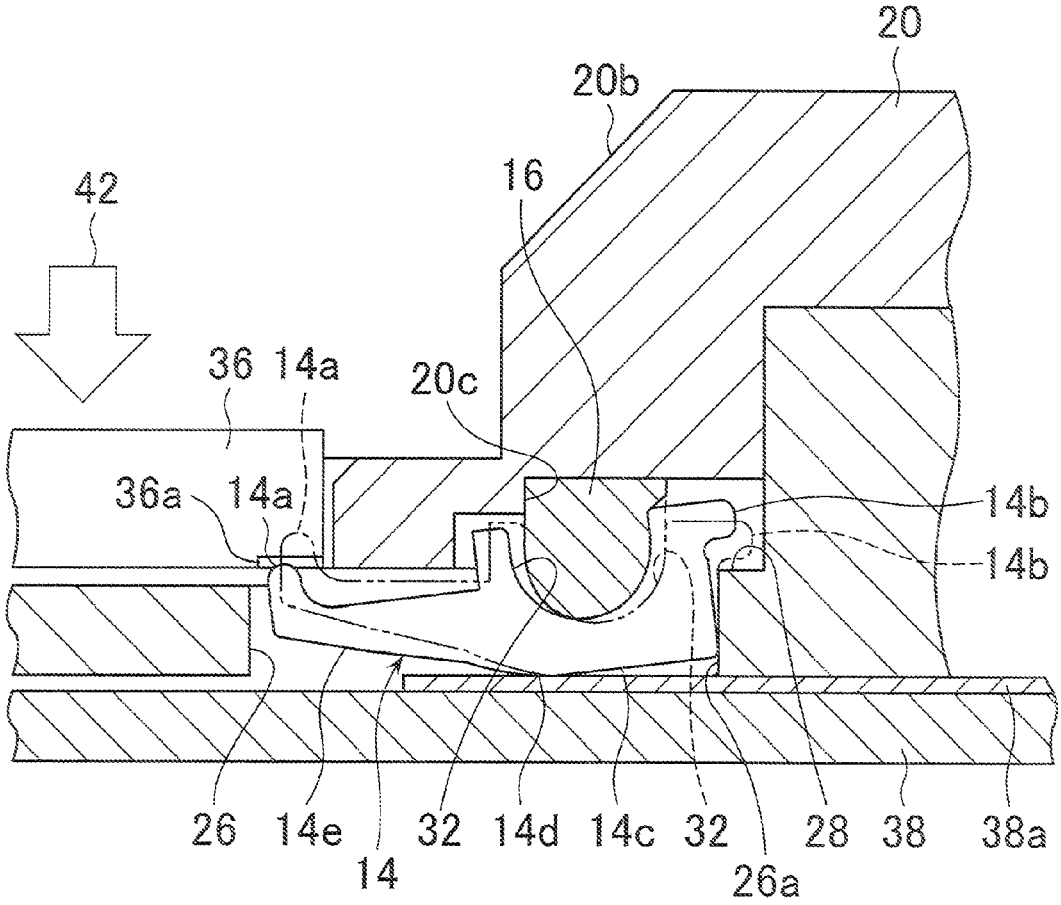
FIG. 8 is a sectional view, partly enlarged, showing a state of use of the electrical connecting apparatus according to the present invention.

By the attachment of the cap member 20 to the frame member 12, each elastic member 16 is sandwiched between the shallow groove 30 of the frame member 12 and the underside 20*a* of the cap member 20 (see FIGS. 7 and 8).

At the upper part of the inner edge of the cap member 20, as shown in FIG. 7, an inclined face 20*b* for guiding the semiconductor device 36 such as IC which is a device under test having a rectangular planar shape toward the bottom portion 22*a* of the recess 22 below is formed by chamfering.

After the attachment of the cap member 20, as shown in FIGS. 7 and 8, the wiring base plate 38 is secured to the underside 12*b* of the frame member 12. In the illustration, the wiring base plate 38 is secured to the frame member 12 by means of bolts 40 to be screwed into the screw holes 40*a* formed in the frame member 12.

FIG. 8 shows a state where the cap member 20 and the wiring base plate 38 are respectively attached to the upper face 12*a* and the underside 12*b* of the frame member 12. As is well known, a plurality of wiring portions 38*a* including conductive paths respectively to be connected to an electric circuit of a test device such as a tester (not shown) are formed, and the contacts 14 align in correspondence with the wiring portions 38*a*.

In a state that no semiconductor device is disposed on the bottom portion 22*a* of the recess 22, as shown by an imaginary line in FIG. 8, each contact 14 is held such that the horizontal lower edge portion 14*c* abuts against the corresponding wiring portion 38*a*. In this state, the tip 14*a* is held as it is projected largely upward from the surface of the bottom portion 22*a* of the recess 22, and the stretched portion 14*b* is mounted on the staged portion 28, that is, the edge 28 of the slot 26. As the stretched portion 14*b* stretches to the edge 28, even if the fitting of the elastic body into the fitting recess 32 of the contacts 14 is loosened, for example, due to a deformation of the elastic member 16, engagement of the stretched portion 14*b* with the edge 28 surely prevents the contact 14 from coming out of the corresponding slot 26. Consequently, the stretched portion 14*b* serves as a falling-off preventing portion of the contacts 14.

When the semiconductor device 36 is dropped from above the cap member 20 toward the bottom portion 22*a* of the recess 22 with the electrode 36*a* on the underside of the semiconductor device directed downward, the semiconductor device 36 is surely guided to a position where each electrode 36*a* abuts against the tip 14*a* of the corresponding contact 14, by guiding action of the inclined surface 20*b* of the cap member 20, and when the pressing force shown by the arrow 42 in FIG. 8 works on the semiconductor device 36, the pressing force acts as moment force on the contact 14.

By this moment force, the contacts 14 elastically held by the elastic member 16 causes a slight rotation counterclockwise as seen in FIG. 8 with a part of the curved surface 14*d* formed at the lower edge and abutting the wiring portion 38*a* as a fulcrum. With this rotation, the contact portion 14*d* of the contact 14 with the wiring portion 38*a* moves toward the tip 14*a* of the contact 14, and the contact 14 causes a slight displacement rightward in the drawing as a whole. This slight displacement, controlled by the outer wall 26*a* of the slot 26, causes lateral shearing force in the drawing to the elastic member 16 from one of its vertical side faces 16*c*. However, the staged portion 20*c* receiving another vertical side face 16*c* of the elastic member 16 is formed on the underside 20*a* of the cap member 20 receiving the top face 16*a* of the elastic member 16 has a staged portion 20*c* receiving the other vertical side face 16*c* of the elastic member 16, thereby restraining an excessive shearing deformation of the elastic member 16. By this, the elasticity of the elastic member 16 enables the contacts 14 to ensure a proper swinging stroke from the attitude of the imaginary line as illustrated to the attitude shown by the solid line in the drawing to restrain excessive sliding on the wiring portion 38*a* of the contacts 14, thereby ensuring the connection between the tips 14*a* of the contacts 14 and the electrodes 36*a* of the semiconductor device 36 as well as the connection between the contact portions 14*d* of the contacts 14 and the wiring portion 38*a* of the wiring base plate 38, and wearing and damage of the contact portion 14*d* of the contact portions 14*d* of the contacts 14 and the wiring portion 38*a* can be restrained.

The curved surface 14*d* can be dispensed with, but in order to surely prevent a damage to the wiring portions, it is desirable that the parts 14*d* serving as the fulcrums of the contacts 14 be a curved surface.

Also, when the contacts are swinging, as shown in FIG. 8 by the solid line, even if a gap is caused between the circumferential wall of the fitting recess 32 and the other vertical side face 16*c*, thereby loosening the fitting of the elastic member 16 and the contacts 14, the falling off action of the contacts 14 from the slots 26 is surely prevented by the falling-off preventing action of the stretched portion 14*b*.

The semiconductor device 36 takes a predetermined electrical test by the connection of the electrodes 36*a* of the semiconductor device 36 through the contacts 14 and the wiring base plate 38 connected to the electric tester and the wiring portion 38*a* connected to the electric circuit of the tester.

When any deficiency such as defect and the like is caused to the contacts 14 of the electrical connecting apparatus 10, the semiconductor device 36 which is a device under test is removed from the electrical connecting apparatus 10, and then a deficient contact can be replaced. For this replacement of the contact 14, the bolts 18 are loosened, and the cap member 20 as well as the bolts 18 are loosened, and the cap member 20 is removed together with the bolts 18 from the enlarged opening 24 of the frame member 12.

By this, as shown in FIG. 4, each probe assembly 14, 16 is exposed to the recess 22 of the frame member 12. Among them, the probe assembly 14, 16 including the deficient contact 14 is pulled up above the enlarged opening 24 as shown in FIG. 2, and the deficient contact 14 is replaced with a normal one. After the contact 14 is replaced, the probe assembly 14, 16 of which the deficient contact was replaced with the normal contact 14 is disposed at a predetermined position so that the elastic member 16 may fit into the predetermined shallow groove 30 and that each contact 14 may fit into the corresponding slot 26. Then, as mentioned above, the cap member 20 is secured to the frame member 12 with the bolts 18, whereby the replacing work of the contacts 14 is finished.

Thus, it is not necessary to remove the wiring base plate 38 from the frame member 12 when replacing the contact 14, attachment work of the wiring base plate 38 which requires adjustment work between the horizontal lower edge portion 14*c* of each contact 14 and the corresponding wiring portion 38*a* of the wiring base plate 38 becomes no longer necessary, thereby remarkably improving the efficiency in exchanging contacts 14.

Also, even in a state that the wiring base plate 38 is removed from the frame member 12, for example, to replace the wiring base plate 38, there is no fear for the elastic member 16 to come off the frame member 12, so that replacement of the wiring base plate 38 can be more easily carried out than heretofore.

For replacement of the contact 14, the wiring base plate 38 is removed as heretofore, the deficient contact 14 is pulled out of each slot 26, and a normal contact 14 can be inserted into the frame member 12 through the slot 26 to replace the deficient one. As mentioned above, however, in order to accelerate the replacement work, it is desirable to take out the deficient contact 14 from above the frame member 12 in each probe assembly 14, 16, and replace it with the normal one.

Also when assembling the electrical connecting apparatus 10, it is desirable to attach the wiring base plate 38 to the underside 12*b* of the frame member 12, then to dispose each probe assembly (14, 16) within the frame member, and thereafter, to attach the cap member 20 to the enlarged opening 24 of the frame member 12. Through such assembling steps, the position of the wiring portion 38*a* of the wiring base plate 38 can be visually confirmed through the slot 26 before assembling the probe assembly (14, 16) into the frame member 12, thereby facilitating proper attachment of the wiring base plate 38.

Figure 9:
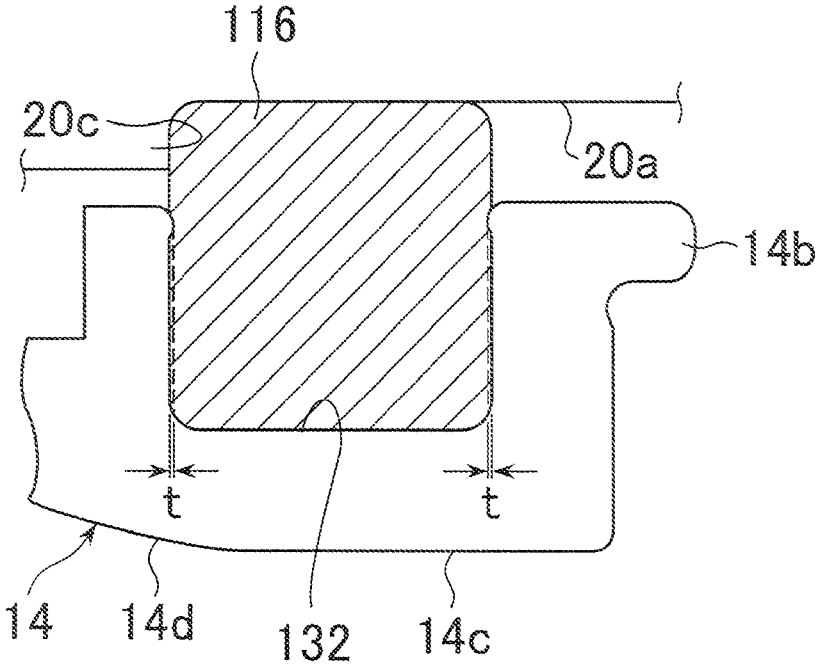
FIG. 9 is a view similar to FIG. 3 showing another embodiment according to the present invention.
Figure 10:
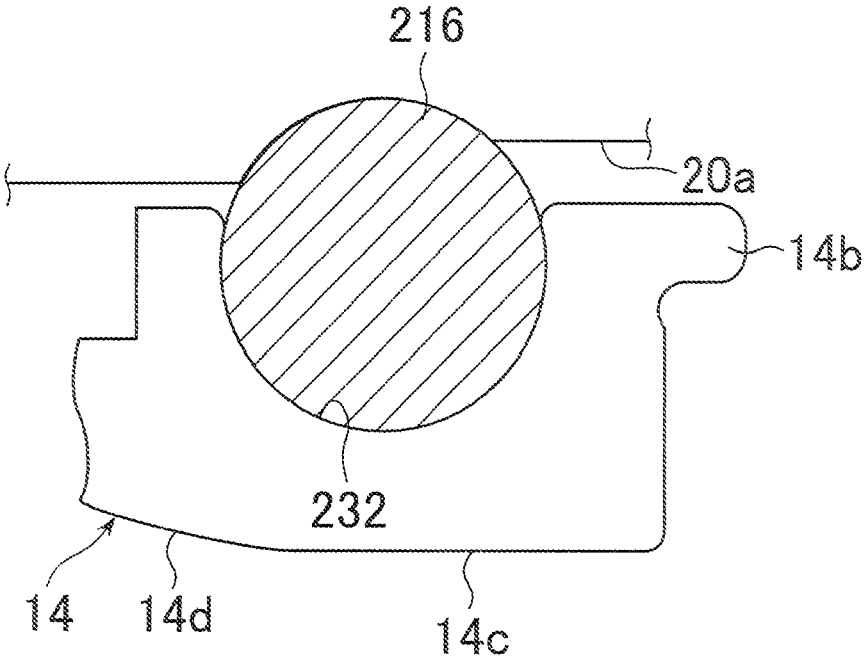
FIG. 10 is a view similar to FIG. 3 showing still another embodiment according to the present invention.

In place of the elastic member 16, an elastic member 116 or 216 having a rectangular or a circular shape in section as shown in FIGS. 9 and 10 can be used. In this case, as shown in FIGS. 9 and 10, fitting recesses of the contacts 14 are shaped to correspond to the shapes of the respective elastic members 116 and 216. In the example shown in FIG. 9, the margin t for tightening as shown in FIG. 3 is given, thereby ensuring elastic coupling of the elastic member 116 and the contact 14. Also, in the example shown in FIG. 10, a circumferential area exceeding the semicircle of the elastic member 216 is given to the fitting portion 232, and by tightening this circumferential area, elastic coupling of the elastic member 216 and the contact is ensured.

Though not shown, the shallow groove 30 is given a sectional shape adapted to receive the elastic members 116, 216 as shown in FIGS. 9 and 10.

Figure 11:
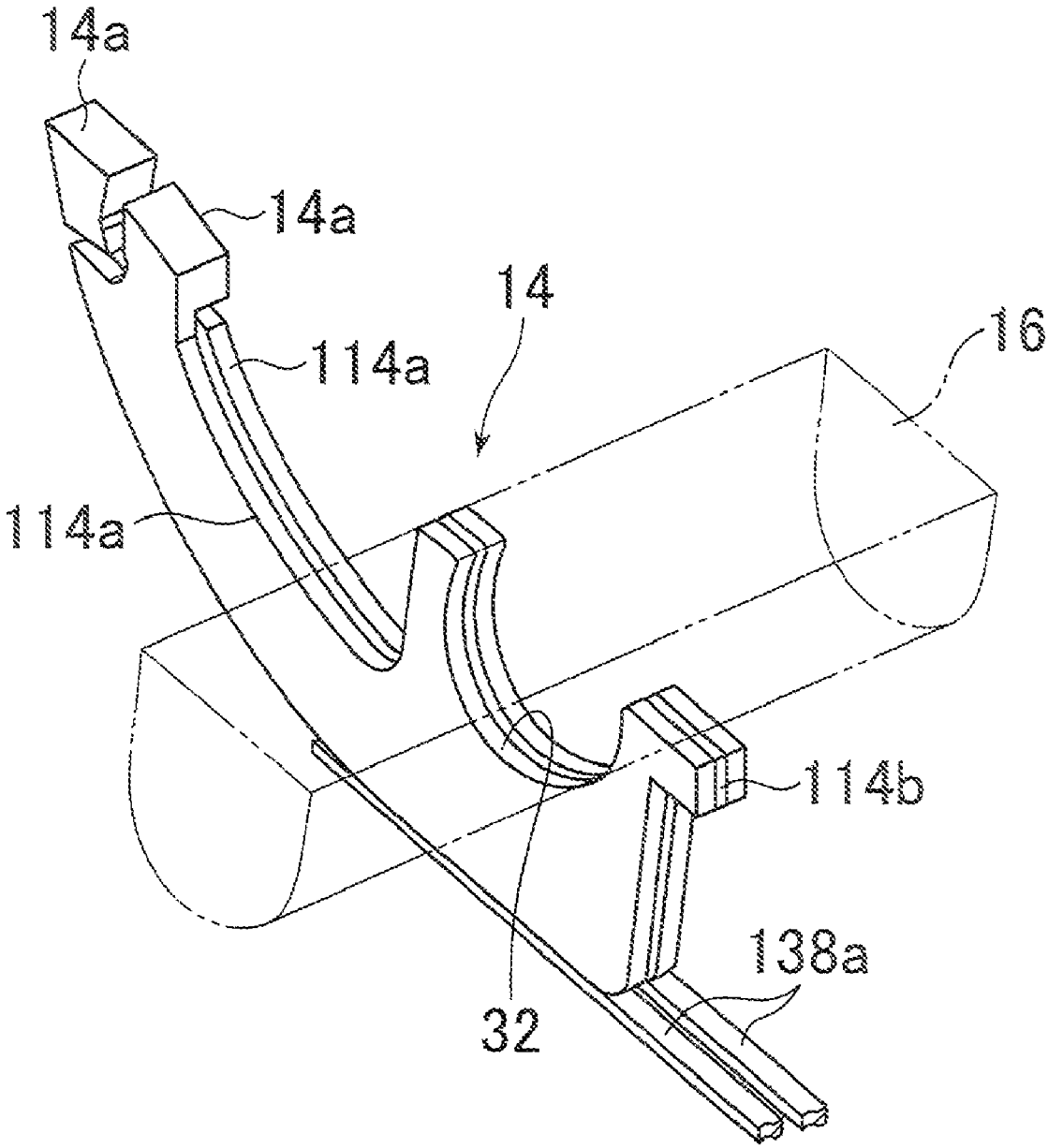
FIG. 11 is a perspective view of the contact showing yet another embodiment according to the present invention.

As the contacts 14 according to the present invention, a Kelvin contact 14 can be used as shown in FIG. 11. The Kelvin contact 14 has, as is well known heretofore, a pair of conductive layers 114*a* and a laminated structure having an electric insulating layer 114*b* disposed between the conductive layers in correspondence to a pair of wiring portions 138*a* on the wiring base plate 38, wherein a pair of tips 14*a*, 14*a* formed in each conductive layer are disposed with a delay forward and backward in the extending direction of the contacts 14, while with the Kelvin contact 14, both its tips 14*a*, 14*a* are used so as to contact the same electrode 36*a* of the semiconductor layer.

INDUSTRIAL APPLICABILITY

The present invention is not limited to the foregoing embodiments but can be variously modified without departing from its spirit.

What is claimed is:

1. An electrical connecting apparatus comprising:

a frame member having a recess for receiving a device under test provided with a plurality of electrodes;

a plurality of contacts provided in correspondence to the electrodes;

a plurality of slots formed on the bottom portion of the recess of said frame member and arranged parallel to each other so as to receive said contacts such that the tip of each contact can abut the corresponding electrode;

an elastic member disposed to cross said slots over the bottom portion in said recess to elastically hold said contacts, each contact adapted to rotate around the elastic member; and a cap member removably coupled to said frame member to sandwich said elastic member together with said frame.

2. An electrical connecting apparatus as claimed in claim 1, further comprising a wiring base plate to be secured to the underside of said frame member and forming a wiring portion to be pressed by said contacts when the tips of said contacts are pressed down by said electrodes.

3. An electrical connecting apparatus as claimed in claim 1, wherein a falling-off preventing portion capable of engaging with a corresponding edge of said slot is formed at a tail end of each contact, said falling-off preventing portion extending away from said tail end of each contact so as to engage with a corresponding edge of said slot.

4. An electrical connecting apparatus as claimed in claim 1, wherein each contact has a fitting recess permitting said elastic member to press fit, and wherein the elastic member and each contact are elastically coupled by the press fitting of said elastic member into said fitting recess.

5. An electrical connecting apparatus as claimed in claim 4, wherein said contacts, when not being subjected to the pressing force from said electrodes of said device under test, are held with the tips projected from said slots into said recess by the elastic force of said elastic member.

6. An electrical connecting apparatus as claimed in claim 5, wherein a contact portion where said contacts abut the wiring portions is a curved surface.

7. An electrical connecting apparatus as claimed in claim 5, wherein said recess is a recess having a rectangular planar shape, wherein said cap member is an annular member having a rectangular planar shape to fit into said recess, and wherein, on the face where the elastic member of said annular member abuts, a staged portion for restraining a shearing deformation of the elastic member is formed so as to restrain excessive movement of the contact portion of said contacts on said wiring portion which accompanies a shearing deformation of the elastic member due to the pressing force from said electrode.

8. An electrical connecting apparatus as claimed in claim 6, wherein a guide face is formed in the upper inner edge portion of said cap member in order to guide said device under test to a testing position where the electrodes of said device under test and the tips of the corresponding contacts are in correspondence with each other.

9. An electrical connecting apparatus as claimed in claim 1, wherein the elastic member has a quadrilateral cross-sectional shape.

10. An electrical connecting apparatus as claimed in claim 1, wherein the elastic member has a circular cross-sectional shape.

* * * * *